US009486083B2

(12) United States Patent
Berenson et al.

(10) Patent No.: US 9,486,083 B2
(45) Date of Patent: Nov. 8, 2016

(54) FLOATING LOUNGE WITH IMPROVED BACK SUPPORT

(71) Applicant: AQUA-LEISURE INDUSTRIES, INC., Avon, MA (US)

(72) Inventors: Steven M. Berenson, Canton, MA (US); Peter Santaw, Middleboro, MA (US); Jeffrey J. LeBlanc, East Greenwich, RI (US); Benjamin Gould, Norwood, MA (US)

(73) Assignee: Aqua-Leisure Industries, Inc., Avon, MA (US)

( * ) Notice: Subject to any disclaimer, the term of this patent is extended or adjusted under 35 U.S.C. 154(b) by 27 days.

(21) Appl. No.: 14/326,815

(22) Filed: Jul. 9, 2014

(65) Prior Publication Data

US 2015/0289663 A1 Oct. 15, 2015

Related U.S. Application Data

(60) Provisional application No. 61/979,116, filed on Apr. 14, 2014.

(51) Int. Cl.

| | |
|---|---|
| ***B63B 35/74*** | (2006.01) |
| ***A47C 15/00*** | (2006.01) |
| ***B63B 35/85*** | (2006.01) |

(52) U.S. Cl.

CPC ..... *A47C 15/006* (2013.01); *B63B 35/74* (2013.01); *B63B 35/85* (2013.01)

(58) Field of Classification Search

CPC .... A47C 15/006; A47C 27/087; A47C 4/54; B63B 35/76; B63B 35/74; B63B 35/73; B63B 35/78; A63B 2225/605; A63B 2225/62

USPC ..... 114/345; 441/129–132; D21/803, 809

See application file for complete search history.

(56) References Cited

U.S. PATENT DOCUMENTS

| | | | | |
|---|---|---|---|---|
| 3,736,027 | A * | 5/1973 | Stafford | A47C 4/54 297/452.43 |
| 4,771,722 | A * | 9/1988 | Tihany | B63B 35/73 114/343 |
| 5,101,753 | A * | 4/1992 | Hull | B63B 7/085 114/345 |
| 5,733,158 | A * | 3/1998 | Higginbotham | B63C 9/06 441/38 |
| 6,634,914 | B2 * | 10/2003 | Vancil | B63B 35/613 441/38 |
| 2006/0075955 | A1 * | 4/2006 | DeChant | B63B 7/085 114/345 |

* cited by examiner

*Primary Examiner* — Andrew Polay
(74) *Attorney, Agent, or Firm* — Wolf, Greenfield & Sacks, P.C.

(57) ABSTRACT

According to one aspect, embodiments of the invention provide a recreational floatation device comprising a body portion comprising an inflatable member having a first inner perimeter surrounding a first inner area, a first support portion comprising a layer of material extending through the first inner area and attached to the inflatable member at its first inner perimeter to support a user of the device, a back support member located within said first inner area, a hinge mechanism coupled to the back support member and the first inner perimeter and configured to allow the back support member to rotate between a first position, wherein a substantial portion of the back support member extends generally away from the first inner area, and a second position, in which the back support member lies substantially within the first inner area.

19 Claims, 5 Drawing Sheets

FLOATING LOUNGE WITH IMPROVED BACK SUPPORT

CROSS REFERENCE TO RELATED APPLICATIONS

This application claims priority under 35 U.S.C. §119(e) to U.S. Provisional Application Ser. No. 61/979,116 entitled "FLOATING LOUNGE WITH IMPROVED BACK SUPPORT," filed on Apr. 14, 2014, which is incorporated herein by reference in its entirety.

BACKGROUND

1. Field of Invention

This invention relates generally to recreational flotation devices, and particularly to floating mattresses or lounges.

2. Discussion of Related Art

Floating mattress or lounges are among the most popular beach and pool recreational devices. They are typically inflatable and may comprise a bladder or buoyant member forming the outer portion of the device, with an inner portion, often made of a layer of plastic or mesh material upon which the user sits or reclines, attached around the inner border of the buoyant member. Some lounges have a raised portion at one end of the buoyant member, which raised portion may serve as a headrest and/or back support, depending on the position of the user.

SUMMARY

One embodiment of the lounge of the instant invention comprises a buoyant member formed generally in the shape of a "figure 8," surrounding a seat area and a foot area, each area preferably comprising a layer of plastic mesh or other non-inflatable material attached to the inner periphery of the buoyant member within each the two parts of the "figure 8." A back support cushion, which may be inflatable, is attached to the bladder within the seat area with hinge mechanisms affixed on each side of the cushion and on opposing inner sides of the bladder, as described more fully below. The back support cushion may be moved or rotated via the hinge mechanisms, between an upright position in which the cushion extends away from the seat area and preferably rests against the inner back edge of the bladder, and a lowered position in which the cushion lies flat in the plane of the lounge. A second, removable cushion may be adapted to fit within the foot area.

At least some aspects and embodiments of the invention are directed toward a recreational floatation device comprising a body portion comprising an inflatable member having a first inner perimeter surrounding a first inner area, a first support portion comprising a layer of material extending through the first inner area and attached to the inflatable member at its first inner perimeter to support a user of the device, a back support member located within said first inner area, and means for rotatably connecting said back support member to said inflatable member at its first inner perimeter so that said back support member may be moved between a first position, wherein a substantial portion of the back support member extends generally away from the first inner area, and a second position, in which the back support member lies substantially within the first inner area.

According to one embodiment, the inflatable member further has a second inner perimeter surrounding a second inner area, and the recreational floatation device further comprises a second support portion comprising a layer of material extending through the second inner area and attached to the inflatable member at its second inner perimeter. In one embodiment, the recreational floatation device further comprises a removable support member configured to be inserted into the second inner area. In another embodiment, the recreational floatation device further comprises at least one cup holder located within at least one of the body portion and the removable support member.

According to another embodiment, the layer of material of the first support portion is one of plastic and fabric. In one embodiment, the back support member is inflatable. In another embodiment, the body portion is shaped in a general "figure 8" configuration. In one embodiment, the recreational floatation device further comprises at least one handle coupled to the body portion.

Another aspect of the invention is directed toward a recreational floatation device comprising a body portion comprising an inflatable member having a first inner perimeter surrounding a first inner area, a first support portion comprising a layer of material extending through the first inner area and attached to the inflatable member at its first inner perimeter to support a user of the device, a back support member located within said first inner area, a hinge mechanism coupled to the back support member and the first inner perimeter and configured to allow the back support member to rotate between a first position, wherein a substantial portion of the back support member extends generally away from the first inner area, and a second position, in which the back support member lies substantially within the first inner area.

According to one embodiment, the hinge mechanism comprises a male interlocking cylindrical member coupled to the back support member, and a female interlocking cylindrical member coupled to the first inner perimeter of the inflatable member, wherein the male interlocking cylindrical member is configured to be inserted into the female interlocking cylindrical member to rotatably couple the back support member to the first inner perimeter. In one embodiment, the male interlocking cylindrical member comprises a circumferential rim extending outwardly from an outer edge of the male interlocking cylindrical member, the female interlocking cylindrical member comprises at least one circumferential ring extending from an inner side of the female interlocking cylindrical member, and when the male interlocking cylindrical member is inserted into the female interlocking cylindrical member, the rim of the male interlocking cylindrical member rests on the at least one circumferential ring of the female interlocking cylindrical member to prevent the male interlocking cylindrical member from being detached from the female interlocking cylindrical member.

According to one embodiment, at least one of the male interlocking cylindrical member and the female interlocking cylindrical member is molded or machined. According to another embodiment, at least one of the male interlocking cylindrical member and the female interlocking cylindrical member is made from one of Polyvinyl Chloride (PVC), Acrylonitrile Butadiene Styrene (ABS), and Nylon. In another embodiment, the inflatable member further has a second inner perimeter surrounding a second inner area, and the recreational floatation device further comprises a second support portion comprising a layer of material extending through the second inner area and attached to the inflatable member at its second inner perimeter. In one embodiment, the recreational floatation device further comprises a removable support member configured to be inserted into the second inner area. In another embodiment, the recreational floatation device further comprises at least one cup holder located within at least one of the body portion and the removable support member.

According to one embodiment, the layer of material of the first support portion is one of plastic and fabric. In one embodiment, the back support member is inflatable. In another embodiment, the body portion is shaped in a general "figure 8" configuration. In one embodiment, the recreational floatation device further comprises at least one handle coupled to the body portion.

At least one aspect of the invention is directed toward a method for providing a recreational floatation device, the method comprising providing a body portion comprising an inflatable member having an inner perimeter surrounding an inner area, attaching a first support portion comprising a layer of material to the inner area of the inflatable member such that the first support portion extends through the inner area, providing a back support member located within said first inner area, and rotatably coupling the back support member to the inner perimeter with a hinge mechanism configured to allow the back support member to rotate between a first position, wherein a substantial portion of the back support member extends generally away from the first inner area, and a second position, in which the back support member lies substantially within the first inner area.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the disclosure. In the figures, each identical or nearly identical component that is illustrated in various figures is represented by a like numeral. For purposes of clarity, not every component may be labeled in every figure. In the figures.

DETAILED DESCRIPTION

Examples of the methods and systems discussed herein are not limited in application to the details of construction and the arrangement of components set forth in the following description or illustrated in the accompanying drawings. The methods and systems are capable of implementation in other embodiments and of being practiced or of being carried out in various ways. Examples of specific implementations are provided herein for illustrative purposes only and are not intended to be limiting. In particular, acts, components, elements and features discussed in connection with any one or more examples are not intended to be excluded from a similar role in any other examples.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, in the event of inconsistent usages of terms between this document and documents incorporated herein by reference, the term usage in the incorporated references is supplementary to that of this document; for irreconcilable inconsistencies, the term usage in this document controls.

As discussed above, common floating mattresses or lounges have a raised portion at one end of a buoyant member which may serve as a headrest and/or back support, depending on the body position of the user. These fixed headrests or back supports often provide less than optimum comfort. Accordingly, a mattress or lounge having an improved back support member is described herein. According to some embodiments, the improved back support member is located within an inner portion of a lounge and may more comfortably conform to the body of a person using the lounge.

Figure 1:
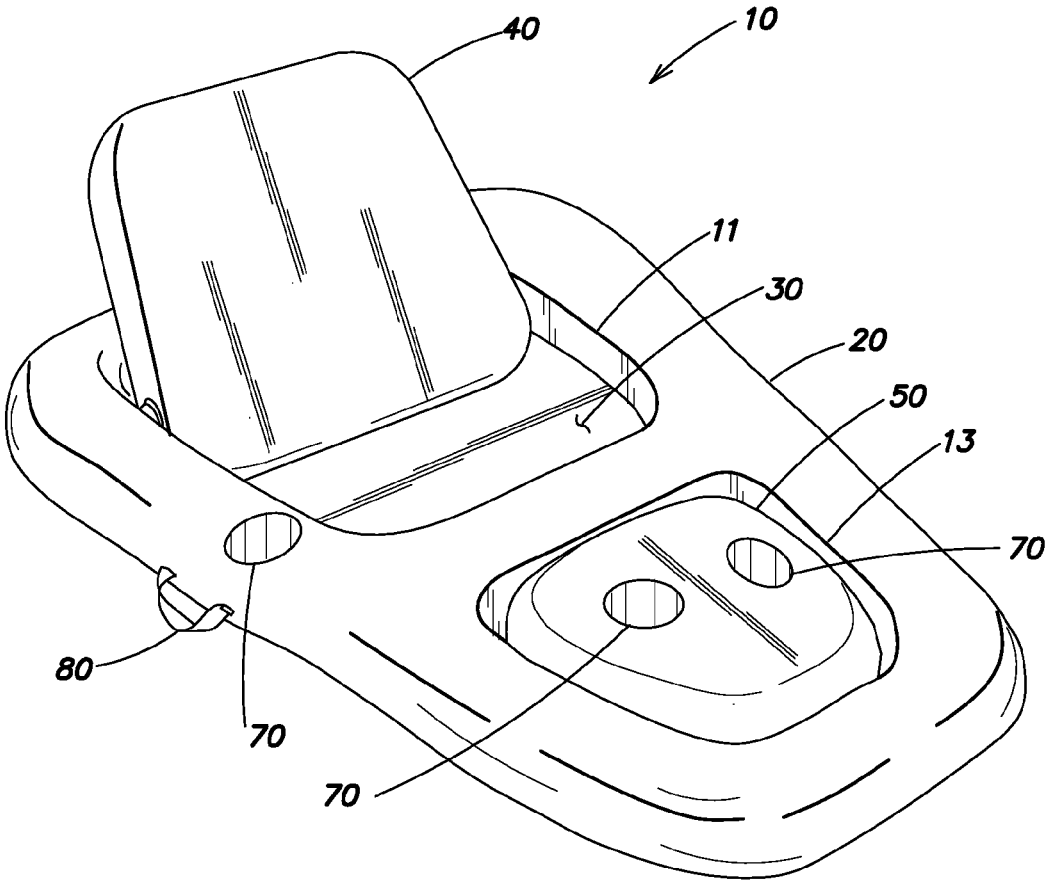
FIG. 1 is a perspective view of a lounge according to at least one embodiment of the invention, having a back support cushion positioned in its seat area, and a second removable cushion positioned in the foot area.

For example, FIG. 1 is a perspective view of a lounge 10 according to at least one embodiment described herein. The lounge 10 comprises an inflatable, buoyant member 20 constructed in conventional fashion, and shaped in a general "figure 8" configuration. Within a first loop 11 of the "figure 8," a sheet of plastic or fabric (e.g., fabric mesh or poplin fabric), or other thin, flexible material, is attached to the buoyant member 20 to form a seat area 30. Back support member 40 is adjustably attached to the buoyant member 20 within and on each side of the seat area 30, as described below. In one embodiment, the back support member 40 is inflatable. In another embodiment, the back support member 40 is made of a rigid material, such as foam.

Figure 8:
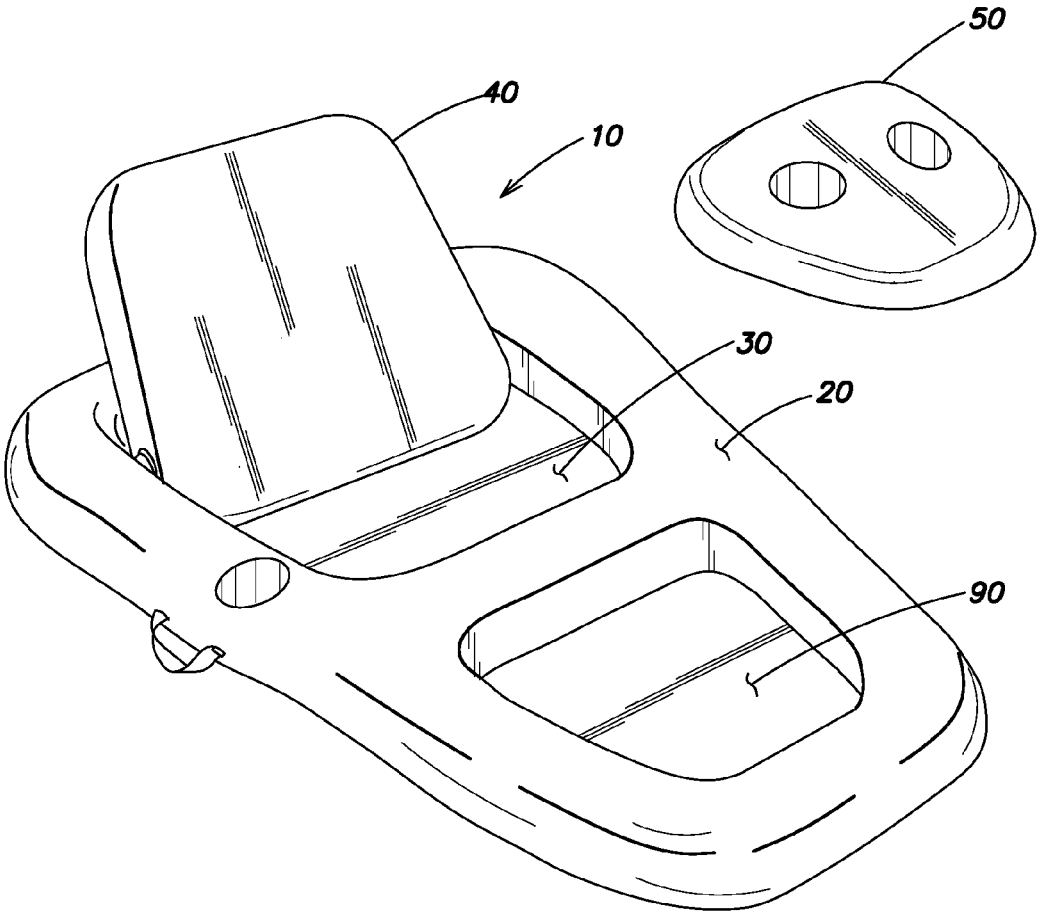
FIG. 8 is a perspective view of the lounge of FIG. 1, with the foot support cushion removed from, but adjacent to, the lounge according to aspects of the present disclosure.

In the second loop 13 of the "figure 8," another sheet of plastic or fabric, or other thin, flexible material, is attached to the buoyant member 20 to form a foot area 90 (e.g., as shown in FIG. 8). A second, removable support member or cushion 50, which may be inflatable, may reside in foot area 90. If desired, lounge 10 may include one or more cup holders 70 formed in inflatable member 20. The foot area cushion 50 may also include one or more cup holders 70. Handles 80 may be provided on each side of lounge 10 to facilitate portability.

Figure 2:
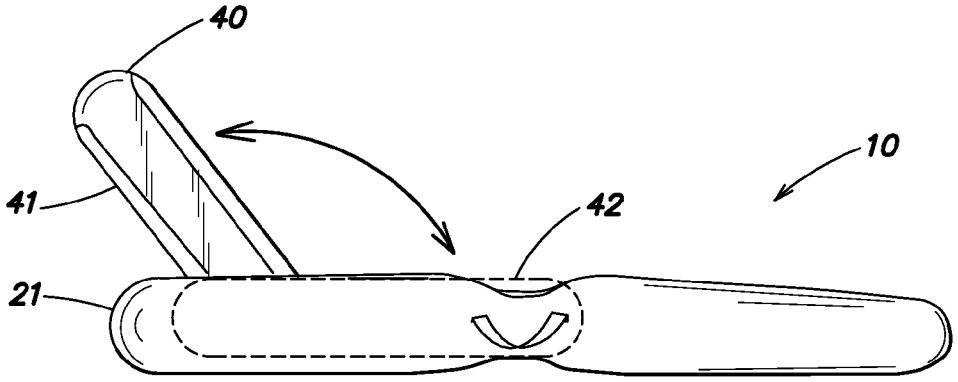
FIG. 2 is a side elevational view of the lounge of FIG. 1, indicating the possible rotation of the back support member from its upward position to its lowered position according to aspects of the present disclosure.

FIG. 2 is a side elevational view of the lounge 10 shown in FIG. 1. FIG. 2 illustrates the adjustability of back support member 40, which may be rotated from its rearmost upward position, shown here in solid line, to the position shown by the dashed lines 42, in which the back support member 40 lies flat within seat area 30.

Figure 3:
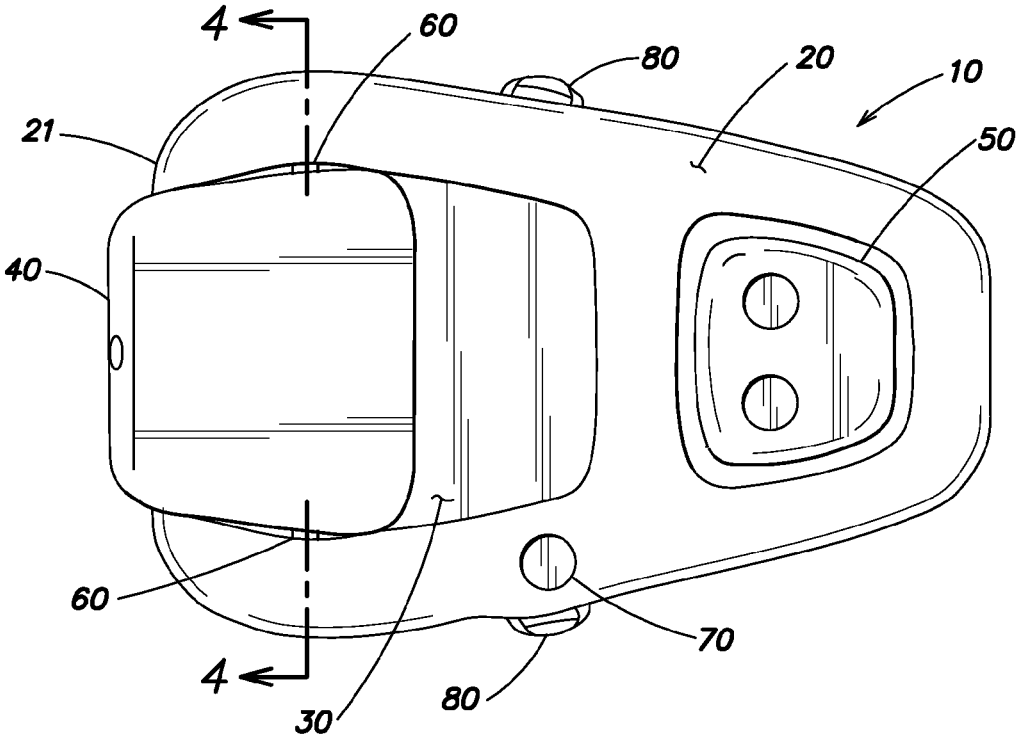
FIG. 3 is a top plan view of the lounge of FIG. 1 according to aspects of the present disclosure.

FIG. 3 is a top plan view of the lounge 10 shown in FIG. 1. FIG. 3 illustrates the lounge 10 with back support member 40 in its rearmost position, the back 41 of the member 40 resting against and being supported by the rear portion 21 of the buoyant member 20.

Figure 4:
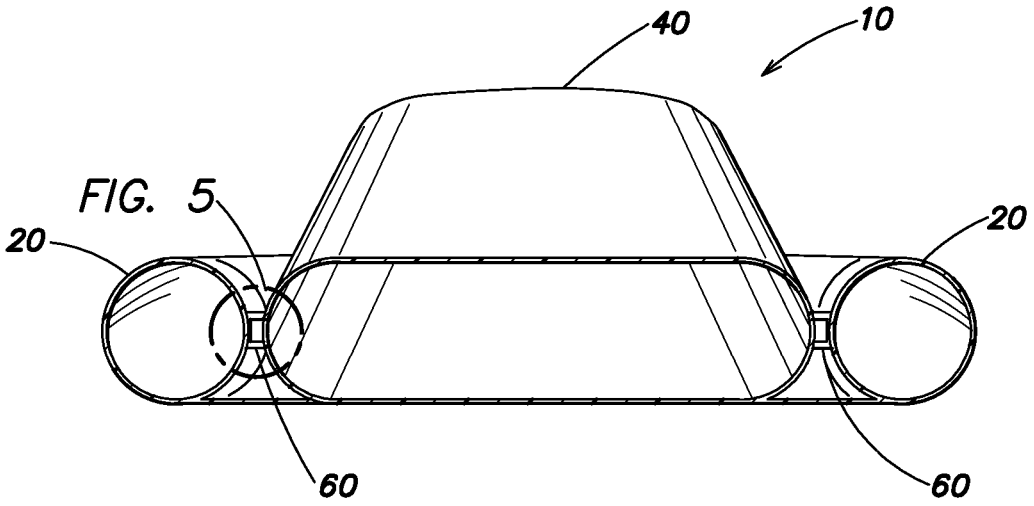
FIG. 4 is a sectional view of the lounge as seen along line 4-4 of FIG. 3 according to aspects of the present disclosure.
Figure 6:
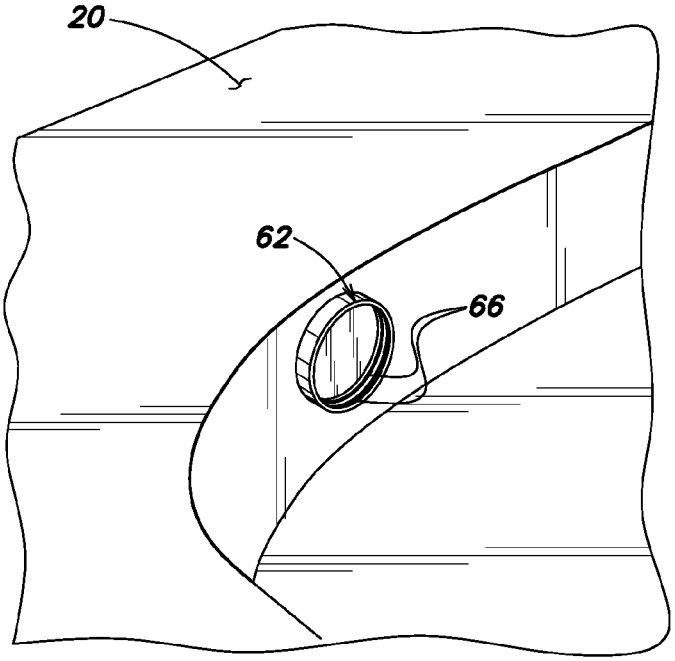
FIG. 6 is a partial view of the inner edge of the inflatable bladder, showing the female member of the hinge mechanism on one side of the seat area according to aspects of the present disclosure.
Figure 7:
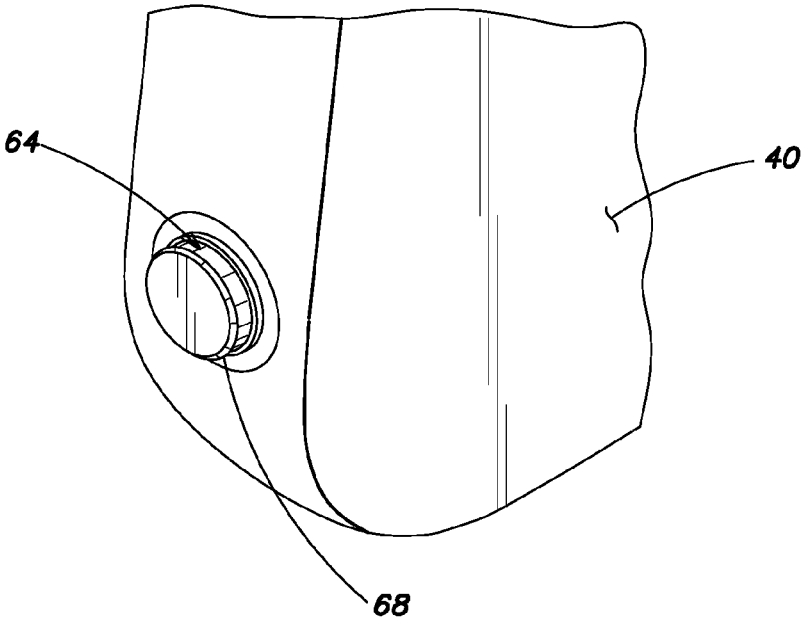
FIG. 7 is a partial view of one side of the back support cushion, showing the male member of the hinge mechanism on one side of the back support cushion according to aspects of the present disclosure.

FIG. 4 is a sectional view of lounge 10 taken along line 4-4 of FIG. 3, the section line 4-4 extending through the hinge mechanisms 60, one on each side of back support member 40. As seen in more detail in FIGS. 5-7, each hinge mechanism 60 is comprised of two interlocking cylindrical members: a female member 62 and a male member 64. According to one embodiment, each member is a molded and/or machined part made from a material such as thermoform Polyvinyl Chloride (PVC), Acrylonitrile Butadiene Styrene (ABS), or Nylon; however, in other embodiments, each member may be made from another appropriate material. The male member 64 is preferably heat welded to one side of back support member 40, while the female member 62 is heat welded to buoyant member 20 at an inner edge 31 adjacent the seat area 30 (see FIG. 3). Female member 62, as shown in FIGS. 5 and 6, includes two inner circumferential rings 66 extending from an inner side 65, while male member 64 has a circumferential rim 68 extending outwardly from its outer edge 67, as shown in FIGS. 5 and 7.

Figure 5:
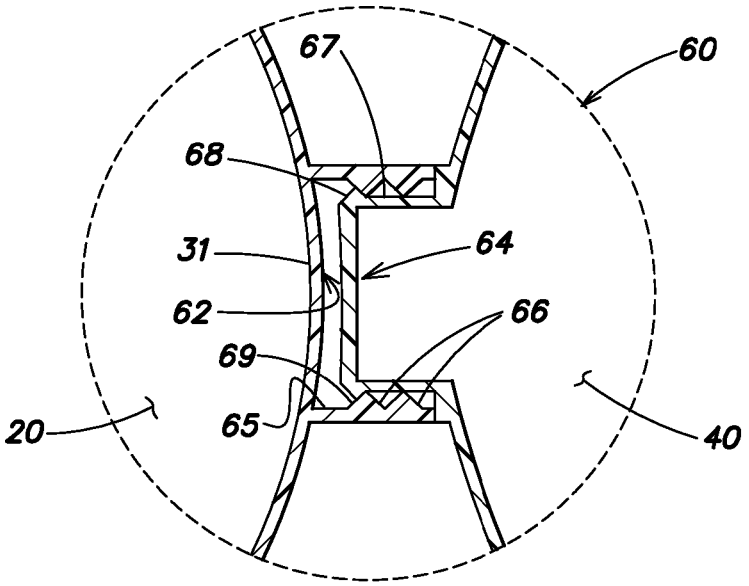
FIG. 5 is a representational close-up view of one of the two hinge mechanisms that connect the back support member to the buoyant member according to aspects of the present disclosure.

Female member 62 and male member 64 may be fitted together by pressing member 64 into member 62 so that, as seen in FIG. 5, rim 68 on male member 64 rests on the innermost side 69 of the innermost ring 66 of female member 62, and prevents male member 64 from easily detaching from female member 62. In one embodiment, because the PVC walls of the two members 62, 64 are only moderately thick (for example, approximately 6 mm), there is enough flexibility in the walls that members 62 and 64 parts may be deformed by hand so as to press-fit them together. According to one embodiment, female member 62 may be approximately 53 mm wide and 10 mm deep, and the male member 64 may be approximately 45 mm wide and 16 mm in length. Hinge mechanisms 60 permit the back support member 40 to be rotated into the desired position within seat area 30, as male members 64 rotate within female members 62.

FIG. 8 is a perspective view of the lounge 10 shown in FIG. 1. FIG. 8 depicts lounge 10 with foot support cushion 50 removed and positioned adjacent lounge 10. The person using the lounge may desire to keep the support cushion 50 floating nearby to hold a drink, sunglasses, etc.

As described above, the lounge 10 is shaped in a general "figure 8" configuration including a first loop 11 and a second loop 13; however, in other embodiments, the lounge 10 may be shaped differently. For example, in some embodiments, the lounge 10 may only include the first loop 11 including the back support member 40 as described above.

As also described above, the male member 64 of the hinge mechanism 60 is coupled to the back support member 40 and the female member 62 of the hinge mechanism 60 is coupled to the buoyant member 20; however, in other embodiments, the male member 64 may be coupled to the buoyant member 20 and the female member 62 may be coupled to the back support member 40.

As described above, the female member 62 includes two rings 66; however, in other embodiments, the female member 62 may include fewer than or more than two rings 66.

As described above, the back support cushion may be moved or rotated, via the hinge mechanisms, between a fully open position in which the cushion extends away from the seat area and preferably rests against the inner back edge of the bladder, and a fully closed position in which the cushion lies flat in the plane of the lounge; however, in other embodiments, the back support cushion may be moved or rotated, via the hinge mechanisms to any number of different intermediate positions between the fully open and fully closed positions.

At least some embodiments described herein provide a mattress or lounge having an improved back support member. According to some embodiments, the back support member, which may be inflatable, is attached to a bladder within a seat area with hinge mechanisms affixed on each side of the back support member and on opposing inner sides of the bladder. The back support member may be moved or rotated via the hinge mechanisms, between an upright position in which the back support member extends away from the seat area and preferably rests against the inner back edge of the bladder, and a lowered position in which the back support member lies flat in the plane of the lounge.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the disclosure. Accordingly, the foregoing description and drawings are by way of example only, and the scope of the disclosure should be determined from proper construction of the appended claims, and their equivalents.

What is claimed is:

1. A recreational floatation device comprising:

an inflatable member having a first loop defined by a first inner perimeter of the inflatable member surrounding a first inner area and a second loop defined by a second inner perimeter surrounding a second inner area;

a back support member located within the first inner area;

a seat area comprising a first layer of material extending throughout the first inner area, including under the back support member, and attached to the inflatable member at the first inner perimeter to support a user of the device;

a foot area comprising a second layer of material extending throughout the second inner area and attached to the inflatable member at the second inner perimeter; and a hinge connecting said back support member to said inflatable member at the first inner perimeter so that said back support member may be moved between a first position and a second position.

2. The recreational floatation device of claim 1, further comprising a cushion positioned in the second inner area.

3. The recreational floatation device of claim 2, further comprising at least one cup holder located within at least one of the inflatable member and the cushion.

4. The recreational floatation device of claim 1, wherein the first layer of material of the seat area is one of plastic and fabric.

5. The recreational floatation device of claim 1, wherein the back support member is inflatable.

6. The recreational floatation device of claim 1, wherein the inflatable member is shaped in a general "figure 8" configuration.

7. The recreational floatation device of claim 1, further comprising at least one handle coupled to the inflatable member.

8. A recreational floatation device comprising:

an inflatable member having a loop defined by an inner perimeter of the inflatable member surrounding an inner area;

a seat area comprising a layer of material extending throughout the inner area and attached to the inflatable member at the inner perimeter to support a user of the device;

a back support member located within the inner area; and a hinge mechanism coupled to the back support member and the inner perimeter and configured to allow the back support member to rotate between a first position and a second position;

wherein the hinge mechanism comprises:

a male interlocking cylindrical member coupled to the back support member; and a female interlocking cylindrical member coupled to the inner perimeter of the inflatable member, wherein the male interlocking cylindrical member is configured to be inserted into the female interlocking cylindrical member to rotatably couple the back support member to the inner perimeter;

wherein the male interlocking cylindrical member comprises a circumferential rim extending outwardly from an outer edge of the male interlocking cylindrical member, wherein the female interlocking cylindrical member comprises at least one circumferential ring extending from an inner side of the female interlocking cylindrical member, and wherein when the male interlocking cylindrical member is inserted into the female interlocking cylindrical member, the rim of the male interlocking cylindrical member rests on the at least one circumferential ring of the female interlocking cylindrical member to prevent the male interlocking cylindrical member from being detached from the female interlocking cylindrical member.

9. The recreational floatation device of claim 8, wherein at least one of the male interlocking cylindrical member and the female interlocking cylindrical member is molded or machined.

10. The recreational floatation device of claim 8, wherein the inflatable member further has a second inner perimeter surrounding a second inner area, and wherein the recreational floatation device further comprises a foot area comprising a layer of material extending throughout the second inner area and attached to the inflatable member at its second inner perimeter.

11. The recreational floatation device of claim 10, further comprising a cushion positioned in the second inner area.

12. The recreational floatation device of claim 11, further comprising at least one cup holder located within at least one of within at least one of the inflatable member and the cushion.

13. The recreational floatation device of claim 8, wherein the layer of material of the seat area is one of plastic and fabric.

14. The recreational floatation device of claim 8, wherein the back support member is inflatable.

15. The recreational floatation device of claim 8, wherein the inflatable member is shaped in a general "figure 8" configuration.

16. The recreational floatation device of claim 8, further comprising at least one handle coupled to the inflatable member.

17. A method for providing a recreational floatation device, the method comprising:

providing an inflatable member having a first loop defined by a first inner perimeter surrounding a first inner area, and a second loop defined by a second inner perimeter surrounding a second inner area;

providing a back support member located within the first inner area;

attaching a seat area comprising a first layer of material to the first inner area of the inflatable member such that the seat area extends throughout the first inner area, including under the back support member;

attaching a foot area comprising a second layer of material extending throughout the second inner area and attached to the inflatable member at its second inner perimeter; and rotatably coupling the back support member to the first inner perimeter with a hinge mechanism configured to allow the back support member to rotate between a first position and a second position.

18. The recreational floatation device of claim 1, wherein in the first position a substantial portion of the back support member extends generally away from the first inner area, and in the second position the back support member lies substantially within the first inner area.

19. The recreational floatation device of claim 8, wherein in the first position a substantial portion of the back support member extends generally away from the inner area, and in the second position the back support member lies substantially within the inner area.

* * * * *